United States Patent [19]

Jennings

[11] Patent Number: 4,702,875

[45] Date of Patent: Oct. 27, 1987

[54] PROCESS FOR PRODUCING HIGH TENACITY POLYHEXAMETHYLENE ADIPAMIDE YARN HAVING RIBBON CROSS-SECTION

[75] Inventor: Uel D. Jennings, Signal Mountain, Tenn.

[73] Assignee: E. I. Du Pont de Nemours and Company, Wilmington, Del.

[21] Appl. No.: 745,059

[22] Filed: Jun. 14, 1985

[51] Int. Cl.[4] ..... D01D 5/092; D01D 5/253

[52] U.S. Cl. ..... 264/177.13; 264/177.17; 264/177.19; 264/210.7; 264/210.8; 264/211.14

[58] Field of Search ..... 264/210.7, 210.8, 176 F, 264/211.14, 177 F, 177.13, 177.17, 177.19, 210.2, 210.5; 425/72 S

[56] References Cited

U.S. PATENT DOCUMENTS

| | | | |
|---|---|---|---|
| 2,273,105 | 2/1942 | Heckert | 264/176 F |
| 2,939,201 | 6/1960 | Holland | 264/177 F |
| 3,067,458 | 12/1962 | Dauchert | 264/176 F |
| 4,225,299 | 9/1980 | Roberts | 425/72 S |
| 4,485,063 | 11/1984 | Good | 264/235.6 |
| 4,524,368 | 7/1985 | Makansi | 425/72 S |

FOREIGN PATENT DOCUMENTS

| | | |
|---|---|---|
| 45-28726 | 9/1970 | Japan . |
| 710087 | 6/1954 | United Kingdom . |
| 830910 | 3/1960 | United Kingdom . |

*Primary Examiner*—Jan H. Silbaugh
*Assistant Examiner*—Hubert C. Lorin

[57] ABSTRACT

A polyhexamethylene adipamide yarn characterized by a tenacity greater than 4.5 g/den., an elongation of from 25–40% constituent ribbon cross-section filaments having a length to width ratio greater than 3 from 9 process for making such yarn including a delayed quench and a two-stage hot chest draw.

2 Claims, 4 Drawing Figures

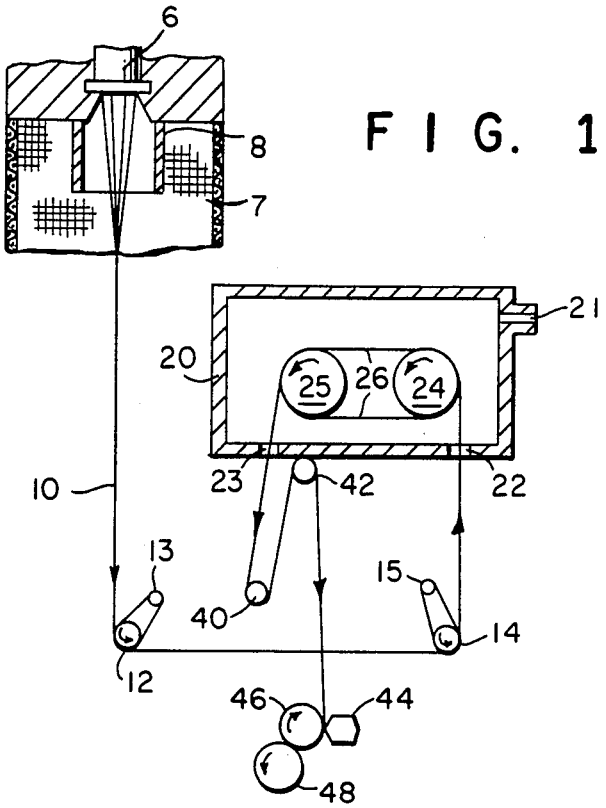
FIG. 1
FIG. 2
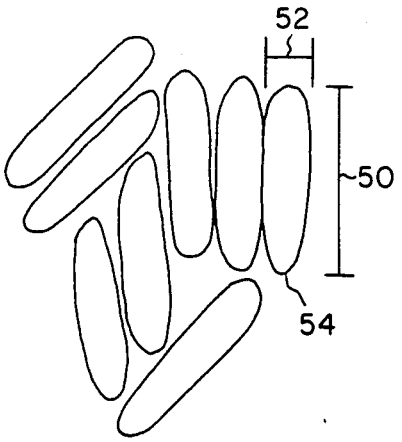

PROCESS FOR PRODUCING HIGH TENACITY POLYHEXAMETHYLENE ADIPAMIDE YARN HAVING RIBBON CROSS-SECTION

BACKGROUND OF THE INVENTION

This invention relates to a high tenacity polyhexamethylene adipamide yarn having a ribbon cross-section as a covering yarn for spandex yarn in women's hosiery and a process for making said covering yarn.

Pantyhose manufacturers have made stockings typically in which spandex with a single covering of textured 15 to 20 denier nylon is knit in alternate courses with a non-textured 15 to 20 denier nylon yarn. Due to the relatively high expense of texturing, it was desirable to develop a covering yarn without the need for texturing. A 6-nylon yarn and a 6.6 nylon yarn each having a ribbon cross-section and used as a covering yarn are known. Because the ribbon cross-section provides a very low bending modulus it facilitates wrapping around the spandex, eliminating the need for expensive textured yarn and requiring about two-thirds the normal covering turns per inch to protect the spandex. However, the 6.6 nylon yarn proved unacceptable due to low yarn tenacity which resulted in low hose burst-strength and wear life. It would be desirable to increase the tenacity and thus the burst-strength and wear life while maintaining a ribbon or high length to width ratio cross-section of the constituent filaments of the yarn.

It is an object of this invention to develop a polyhexamethylene adipamide yarn and a process for producing such yarn with a high tenacity and with constituent filaments having a cross-section with a high length to width ratio.

SUMMARY OF THE INVENTION

The invention provides a polyhexamethylene adipamide yarn characterized by a high tenacity of greater than 4.5, an elongation of between 25 to 40% and constituent filaments having a cross-section of the length to width ratio of greater than 3. The yarn of this invention is produced by melt spinning polyhexamethylene adipamide through a rectangular orifice, delaying quenching of the filaments for a relatively short distance, quenching the filaments, combining the filaments into a yarn bundle, drawing the yarn bundle in a two-stage hot chest draw process and winding.

To improve ribbon yarn tensile properties, it was necessary to depart from the previously used conventional cold draw-roll process, which is limited to low draw ratios. The two-stage hot chest draw is similar to that described in U.S. Pat. No. 4,485,063 as shown in FIG. 1. The quench is delayed by not cooling the filaments for a relatively short distance after leaving the spinneret orifice. It was expected that the delayed quench would reduce the length to width ratio to unacceptably low levels. By utilizing a hot draw-roll process and incorporating delayed quench, tenacities in excess of 5 grams per denier were obtained for yarns with constituent filaments having a cross-section of length to width ratios in excess of 3.0.

The high length to width ratio is obtained by utilizing a rectangular-shaped spinneret orifice with a high length-to-width ratio. It is unexpected and surprising to utilize a delayed quench and still maintain a length to width ratio in excess of 3.0.

BRIEF DESCRIPTION OF DRAWINGS

FIG. 1 is a schematic representation of an apparatus for practicing the process of the invention.

FIG. 2 is a schematic representation of a cross-section of the constituent filaments of the yarn of this invention.

DETAILED DESCRIPTION OF THE DRAWINGS

Figure 3A:
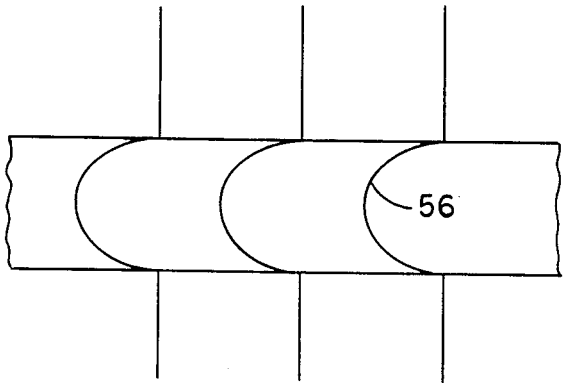
FIG. 3*a* and 3*b* are schematic diagrams showing displaced fringes and no displaced fringes respectively.

FIG. 1 is a schematic representation of a process of this invention and of an apparatus suitable for carrying it out. In FIG. 1, driven roll 12 and associated separator roll 13 define a first draw zone feeding means for yarn 10. Yarn 10 comes from the rectangular spinneret orifices 6 and passes through the cylindrical collar 8, which delays the contact of the filaments with cross-flow quench air flowing through screen 7. Driven roll 14 and associated separator roll 15 comprise the draw rolls for the first drawing stage as well as the feed roll for the second drawing stage. A pair of first and second driven rolls, 24 and 25 respectively, provide the tension for the second drawing stage and maintain the yarn within chest 20 at a constant length by means of multiple yarn wraps 26. Chest 20 is thermally insulated and heated by means of a circulating hot air environment supplied through duct 21. The chest also has a yarn entry 22 and yarn exit 23. Yarn 10 exits the chest under controlled tension provided by puller roll 40 followed by a let down roll 42 prior to being wound up by a conventional winding device comprised of traversing mechanism 44 and drive roll 46 where it is wound into a yarn package 48.

FIG. 2 is a shematic representation of a cross section of the filaments of the yarn of this invention. The ribbon cross section is shown by the high length 50 to width 52 ratio of the filament 54. The configuration of the eight filaments of the yarn is an example of one possible configuration of the constituent filaments of the yarn of the invention.

TEST METHODS

Relative Viscosity

The relative viscosity (RV) of polyhexamethylene adipamide is the ratio of the viscosity of a solution of 8.4 percent (by weight) polymer in a solution of 90 percent formic acid and 10 percent water (by weight) at 25° C., to the viscosity of the formic acid-water solution, per se, measured in the same units at 25° C.

Birefringence

Birefringence is determined by measuring the refractive index parallel ($n_{||}$) and perpendicular ($n_{\perp}$) to the fiber axis by interference microscopy. The difference between the two refractive indices is the birefringence. The microscope is a Leitz transmitted light interference microscope employing a Mach-Zehnder type interferometer. Illumination is provided by a mercury arc lamp filtered to give a wavelength of 546 nm.

Figure 3B:
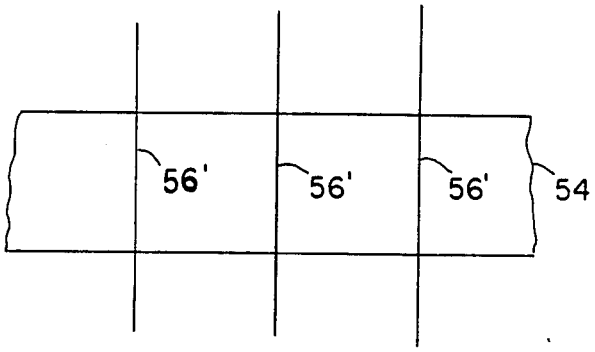

Refractive index measurements are carried out as follows: A plain microscope slide is halved and some fibers are placed on both halves. A few drops of refractive index liquid (Cargille Certified Refractive Index Liquids, R. P. Cargille Laboratories, Inc.) and a cover slip are deposited on both slides. One slide preparation is placed on the sample stage of the microscope and positioned so there are fibers in the field of view. The other preparation is placed on the microscope's reference stage with no fibers in the field of view. This is a standard procedure to ensure that both beams of the interferometer have identical path lengths. The interferometer is adjusted so that vertical flanges appear in the field of view with the fibers oriented perpendicularly to the fringes. To measure $n_{\parallel}$ the microscope's analyzer is set to transmit light vibrating parallel to the fiber axis. The interferometer is adjusted for maximum sharpness of the fringes. If the fringes 56 are displaced when passing through the fiber 54 as in FIG. 3*a*, another preparation is required using a different refractive index liquid. When a fluid is found that doesn't cause a fringe displacement in the fiber, the refractive index of the fluid and fiber are identical as in FIG. 3*b*. The nominal value of the fluid is corrected for wavelength dispersion and temperature by referral to an optical data print-out supplied by Cargille for each of their refractive index liquids. The procedure is then repeated for $n_{\perp}$ after adjusting the analyzer to transmit light perpendicular to the fiber axis.

EXAMPLE

Polyhexamethylene adipamide (66 nylon) polymer of 58 RV containing 0.3% $TiO_2$ delustrant is melt spun at 292° C. through rectangular spinneret capillaries (0.003 in. wide×0.060 in. long) into an 8-filament yarn using the spinning/winding apparatus described in FIG. 1. The freshly extruded threadline is quenched with cross-flow air at room temperature. Almost immediately upon exiting the spinneret, the filaments pass through a 3" (7.62 cm) long cylindrical collar which delays for a short period their contact with the cross-flow quench air. The quenched filament bundle passes in contact to a finish roller (not shown in FIG. 1), then passes 3 wraps over a pair of mirror-surface feed rollers rotating at 938 ypm then passes 2 wraps over a pair of first-stage draw rollers rotating at 1688 ypm, then passes two wraps over a pair of second-stage draw rollers rotating at 3000 ypm then through an interlace jet where it is interlaced, then to a finish roller which applies a standard textile finish, then to the windup. The second stage draw rollers are located in a hot-chest containing air at 170°C. Windup tension is 4 grams.

Yarn and filament characteristics are:

Denier of drawn yarn: 20

Tenacity (gm/denier)(yarn): 5.2

Elongation at break (%)(yarn): 29

Length to width ratio(filament): 3.8

Birefringence (filament): 0.056

I claim:

1. A process for preparing a polyhexamethylene adipamide yarn having ribbon cross-section filaments, said filaments having a cross-section of a length to width ratio of greater than about 3 and a tenacity of greater than about 4.5 g/den., comprising the steps of:

(a) melt spinning polyhexamethylene adipamide filaments through a rectangular spinneret orifice;

(b) quenching the filaments at a distance of greater than about 4 cm. after the filaments leave the rectangular spinneret orifice;

(c) combining the filaments into a yarn bundle;

(d) drawing the yarn bundle in a two-stage hot chest draw process;

(e) winding the yarn bundle;

wherein the length to width ratio of the rectangular spinneret orifice is greater than about 15, and wherein the spun filaments have an RV greater than about 50.

2. The process of claim 1 wherein the filaments are quenched at a distance greater than about 9 cm.

* * * * *

UNITED STATES PATENT OFFICE

CERTIFICATE OF CORRECTION

PATENT NO. : 4,702,875

DATED : October 27, 1987

INVENTOR(S) : Uel D. Jennings

It is certified that error appears in the above-identified patent and that said Letters Patent are hereby corrected as shown below:

Title Page Item [54]
The Title appearing on page 1, and also Column 1, should read -- A PROCESS FOR PRODUCING HIGH TENACITY POLYHEXAMETHYLENE ADIPAMIDE YARN HAVING RIBBON CROSS-SECTION FILAMENTS --.

In the ABSTRACT, the numeral "9" should read -- a --.

Signed and Sealed this

Eighth Day of March, 1988

*Attest:*

DONALD J. QUIGG

*Attesting Officer*

*Commissioner of Patents and Trademarks*